US007134241B2

(12) United States Patent
Suzuki

(10) Patent No.: US 7,134,241 B2
(45) Date of Patent: Nov. 14, 2006

(54) ENTRAPMENT DETECTING DEVICE FOR OPENING-CLOSING MEMBER THAT INCLUDES STRAIN GAUGE

(75) Inventor: Shintaro Suzuki, Kasugai (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 248 days.

(21) Appl. No.: 10/720,258

(22) Filed: Nov. 25, 2003

(65) Prior Publication Data

US 2004/0155617 A1 Aug. 12, 2004

(30) Foreign Application Priority Data

Nov. 27, 2002 (JP) ..... 2002-344334

(51) Int. Cl.
*E05F 15/20* (2006.01)

(52) U.S. Cl. ..... 49/28; 49/26; 49/360; 49/352; 49/28; 318/283; 296/155

(58) Field of Classification Search ..... 49/26, 49/27, 28, 360, 352; 318/466, 280, 283; 296/155, 146.1
See application file for complete search history.

(56) References Cited

U.S. PATENT DOCUMENTS 4,625,291 A * 11/1986 Hormann ..... 702/41
5,198,674 A * 3/1993 Underwood ..... 250/396 ML
5,728,953 A * 3/1998 Beus et al. ..... 73/862.472
5,770,934 A * 6/1998 Theile ..... 318/469
6,009,671 A * 1/2000 Sasaki et al. ..... 49/352
6,161,438 A * 12/2000 Mullet et al. ..... 73/774
6,456,027 B1 * 9/2002 Pruessel ..... 318/445
6,870,334 B1 * 3/2005 Jurado et al. ..... 318/282
2002/0166288 A1 * 11/2002 LeGallo ..... 49/352

FOREIGN PATENT DOCUMENTS

DE 198 10 077 A 9/1998
DE 198 47 080 C 8/2002
JP 8-338173 A 12/1996
JP 9-264094 A 10/1997
JP 2000-160931 A 6/2000

* cited by examiner

*Primary Examiner*—Gregory J. Strimbu
(74) *Attorney, Agent, or Firm*—Buchanan Ingersoll & Rooney PC

(57) ABSTRACT

An entrapment detection device of an opening-closing member which opens and closes an opening portion of a vehicle body includes a driving power source for moving the opening-closing member, a motivity transmission member provided between the opening-closing member and the driving power source, a deformation member configured to be deformed via the motivity transmission member in accordance with the load applied to the opening-closing member during an opening-closing operation of the opening-closing member, a strain gauge assembled to the deformation member and configured to convert a strain according to the deformation of the deformation member to an electric signal and a control mechanism for detecting an entrapment of an external object based on the electric signal from the strain gauge.

16 Claims, 5 Drawing Sheets

ENTRAPMENT DETECTING DEVICE FOR OPENING-CLOSING MEMBER THAT INCLUDES STRAIN GAUGE

This application is based on and claims priority under 35 U.S.C. § 119 with respect to Japanese Patent Application No. 2002-344334 filed on Nov. 27, 2002, the entire contents of which are incorporated herein by reference.

FIELD OF THE INVENTION

The present invention relates to a detecting device. More particularly, the present invention pertains to a detecting device for detecting an entrapment of an external object by an opening-closing member, for example, a sliding door, a sunroof, and a backdoor for vehicles.

BACKGROUND OF THE INVENTION

With the known technology, whether an opening-closing member entraps an external object when the opening-closing member is moved from an open state to a closed state is detected and the movement of the opening-closing member is reversed when it is judged that the external object is entrapped. In order to achieve the foregoing, it is required to detect the entrapment of the external object by the opening-closing member.

Japanese Patent Laid-Open Publication No. H09-264094 describes a device including a sensor provided along an end surface of the opening-closing member. A conduction portion of the sensor is covered with a rubber. When the sensor detects ON state, the device described in Japanese Patent Laid-Open Publication No. H09-264094 detects the entrapment of the external object between the sensor and a vehicle body.

Japanese Patent Laid-Open Publication No. 2000-160931 describes a device for detecting the entrapment of the external object based on a variation of a rotational speed of an electric motor and a variation of an electric current supplied to the electric motor for actuating the opening-closing member.

Notwithstanding, because the detection of the entrapment using the sensor only detects the entrapment at a location provided with the sensor, the entrapment of the external object cannot be detected when the external object is entrapped without contacting the sensor.

In the meantime, with the detection for the entrapment of the external object based on the variation of the rotation speed of the electric motor, because, generally, various members such as a cable and a decelerator are provided between the electric motor and the opening-closing member, a time lag may be generated from the entrapment of the external object until the rotational speed of the electric motor is actually changed. Thus, the timing for detecting the entrapment of the external object after actual entrapment may be delayed.

A need thus exists for a detecting device for an opening-closing member for securely detecting the entrapment of an external object and minimizing the delay of the detection timing.

SUMMARY OF THE INVENTION

In light of the foregoing, the present invention provides an entrapped detection device of an opening-closing member which is opening and closing an opening portion of a vehicle body, which includes a driving power source for moves the opening-closing member, a motivity transmission member provided between the opening-closing member and the driving power source, a deformation member configured to be deformed via the motivity transmission member in accordance with the load applied to the opening-closing member at an opening-closing operation of the opening-closing member, a strain gauge assembled to the deformation member and configured to convert a strain according to the deformation of the deformation member to an electric signal and a control mechanism for detecting an entrapment of an external object based on the electric signal from the strain gauge, a detection device for entrapment of an opening-closing member.

BRIEF DESCRIPTION OF THE DRAWING FIGURES

The foregoing and additional features and characteristics of the present invention will become more -apparent from the following detailed description considered with reference to the accompanying drawing figures in which like reference numerals designate like elements.

DETAILED DESCRIPTION OF THE INVENTION

Figure 1:
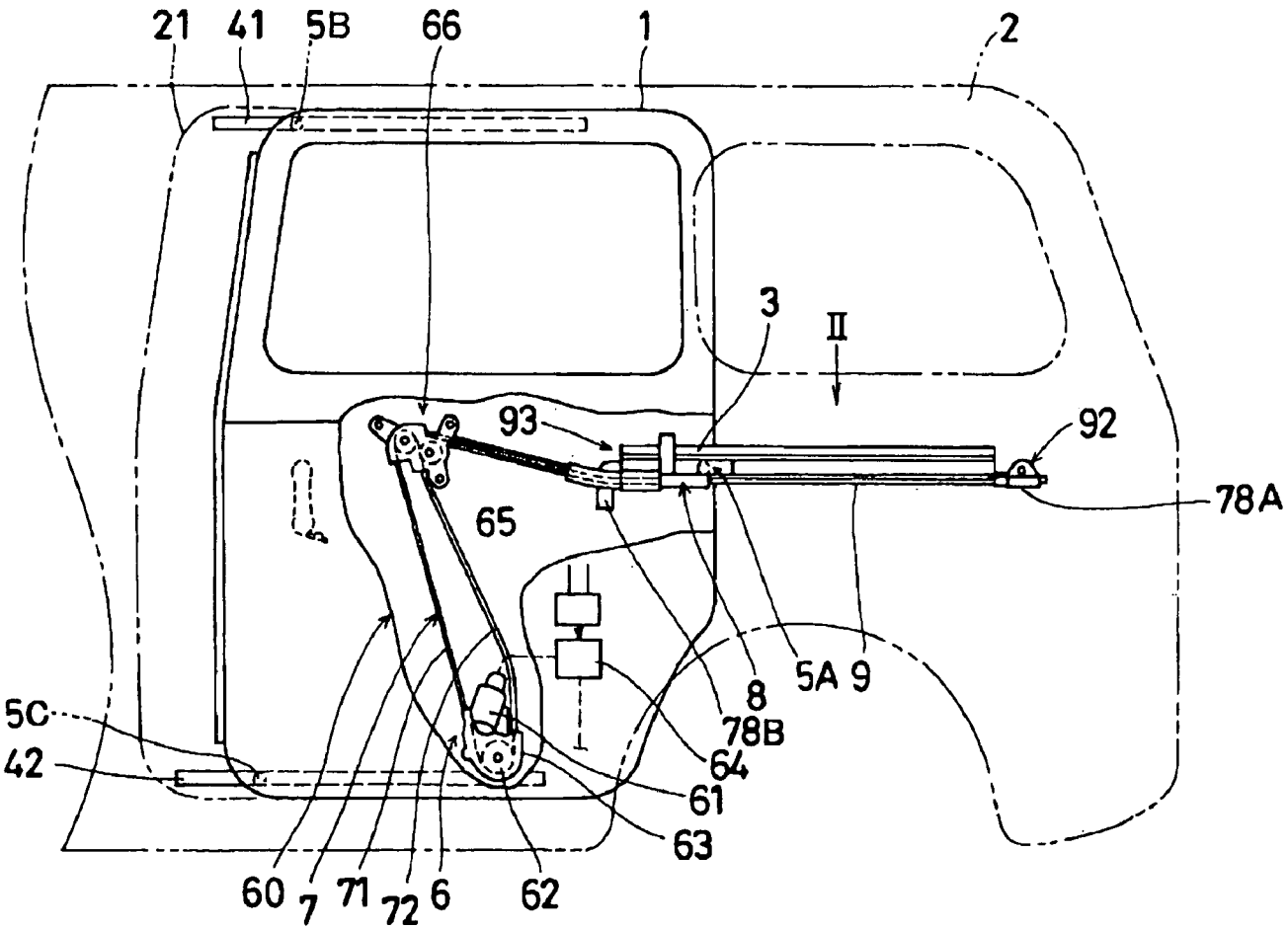
FIG. 1 is a lateral view of a vehicle including a detecting device for an entrapment according to an embodiment of the present invention.

One embodiment of the present invention will be explained with reference to the drawing figures as follows. A slide door for opening and closing a door opening at a lateral side of a vehicle serves as an opening-closing member in the embodiment.

As shown in FIG. 1, a slide door 1 serving as the opening-closing member is slidably supported along the lateral surface of a body 2 via a center guide rail 3 extended in the longitudinal direction (i.e., right, left direction of FIG. 1) of the vehicle and a pair of upper and lower guide rails 41, 42 for opening and closing a door opening 21 formed on the lateral surface of the body 2.

The upper guide rail 41 is positioned along an upper rim of the door opening 21 to be fixed to the body 2. The lower guide rail 42 is positioned along a lower rim of the door opening 21 to be fixed to the body 2. The center guide rail 3 is positioned rearward of the door opening 21 to be fixed to the body 2.

The slide door 1 is supported with guide roller units 5A, 5B, 5C slidably guided by the guide rails 3, 41, 42 respectively. The slide door 1 slides to open and close the door opening 21 by sliding the guide roller units 5A, 5B, 5C, relative to the corresponding guide rails 3, 41, 42, respectively. The guide rails 3, 41, 42 are positioned in parallel with each other. Front ends of the guide rails 3, 41, 42 are bent in the vehicle compartment direction in order to guide the slide door 1 to be approximately flat with the lateral surface of the body 2. The slide door 1 is positioned on the external surface of the body 2 at the rear portion of the vehicle relative to the door opening 21 at the opening state of the door opening 21.

The slide door 1 is slidably supported at the lateral surface of the body 2 by the guide roller units 5A, 5B, 5C via the guide rails 3, 41, 42. The slide door 1 slides by the sliding movement of the guide roller units 5A, 5B, 5C relative to the guide rails 3, 41, 42 by a power slide unit 60.

The power slide unit 60 of the slide door 1 will be explained in details as follow. As shown in FIG. 1, the power slide unit 60 includes a drive mechanism 6, a joint pulley mechanism 66, a cable 7, a pulley mechanism 8, and a cable holder 9. Each mechanism is connected to each other via the cable 7 in the power slide unit 60 and treated as one unit before assembling on the vehicle. Each end portion of the cable holder 9 in the longitudinal direction of the vehicle is provided with a front side bracket 93 and a rear side bracket 92 respectively for assembling the end portion of the cable 7 to the body 2.

The drive mechanism 6 is fixed to a panel of the slide door 1 positioned in the slide door 1. The drive mechanism 6 includes an output drum 62 connected to an output shaft of an electric motor 61 via a deceleration gear mechanism 63 and enables the normal and reverse rotation by switching the rotational direction of the electric motor 61.

Figure 2:
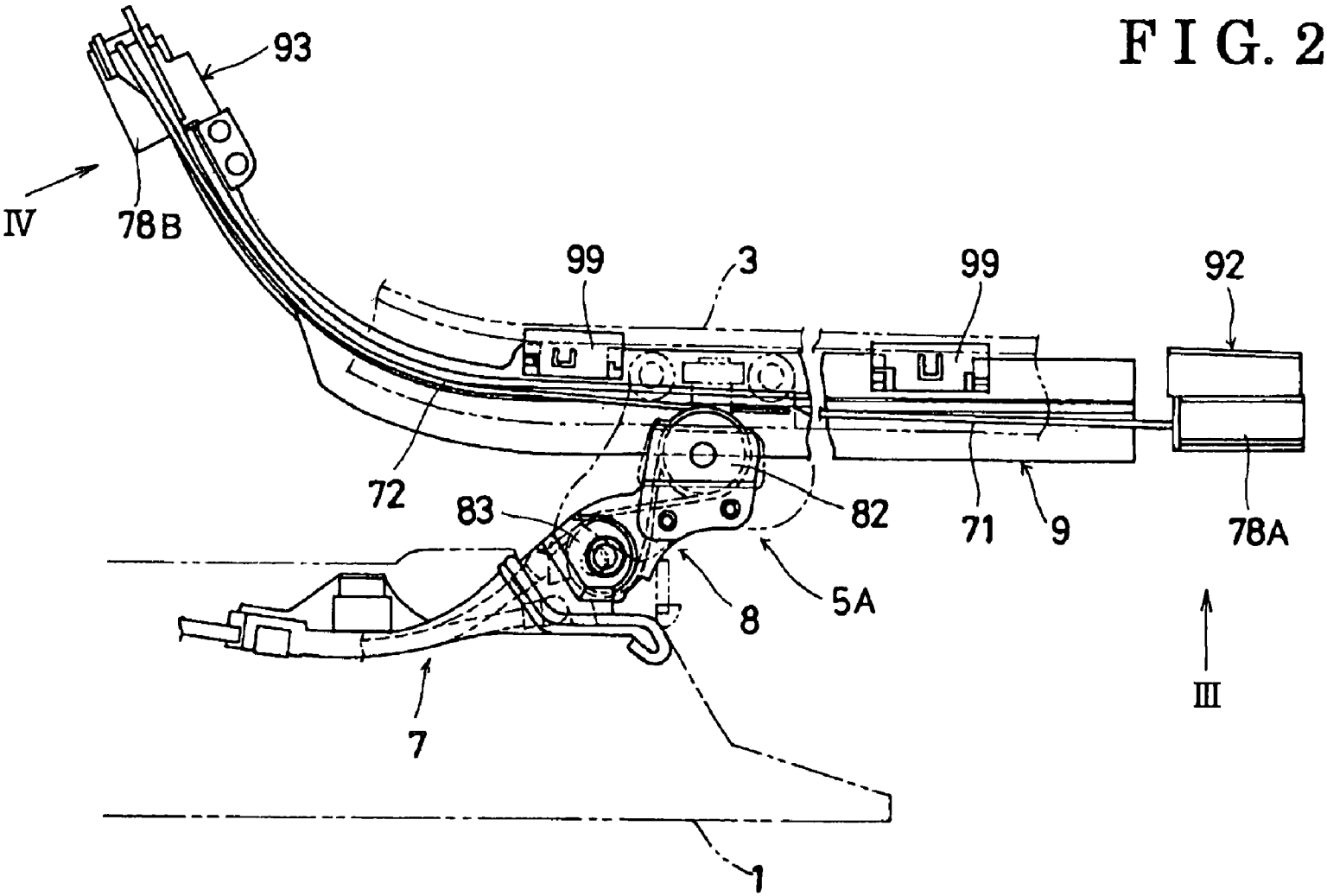
FIG. 2 is a view viewed from II of FIG. 1.
Figure 3:
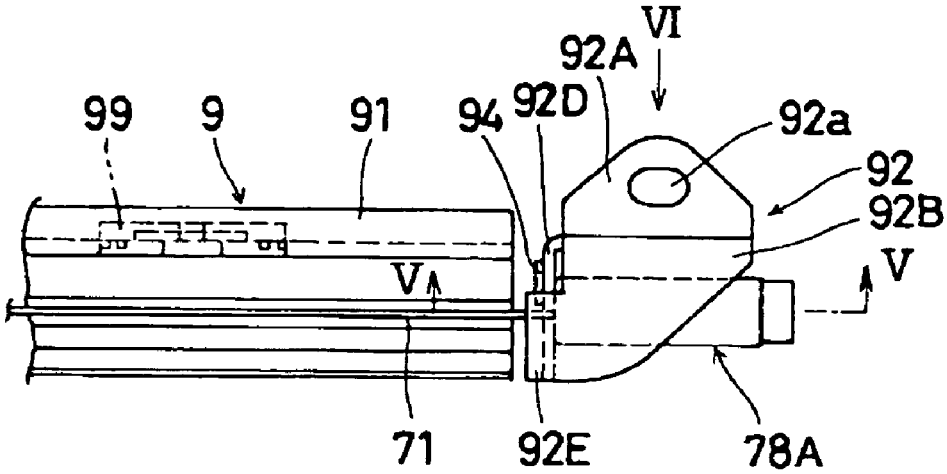
FIG. 3 is a view viewed from III of FIG. 2.
Figure 5:
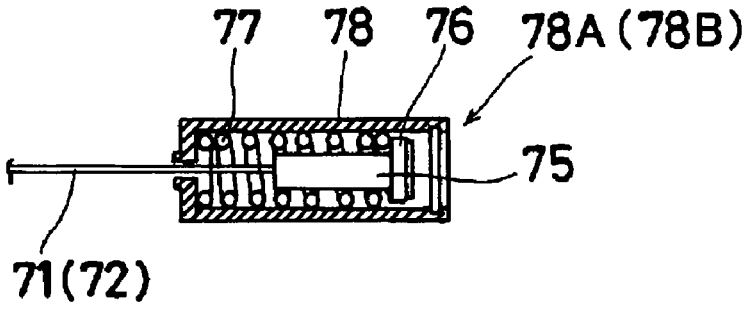
FIG. 5 is a cross-sectional view taken on line V—V of FIG. 3.

The actuation of the electric motor 61 is controlled by a door electric control unit 64 serving as a control mechanism positioned in the slide door 1. The door electric control unit 64 outputs the drive signal to the electric motor 61 for driving the electric motor 61 in the desired direction based on various input signals (e.g., ON, OFF of an opening-closing switch of the slide door 1 and a vehicle speed). The door electric control unit 64 is electrically connected with a battery in the vehicle. The door electric control unit 64 is electrically connected with strain gauges 94, 95 assembled to the front side bracket 93 and the rear side bracket 92 respectively. The strain gauges 94, 95 serve as sensors for perceiving a slight expansion amount of a metal line or a metal foil such as Cu Ni as a change of the electric resistance. As shown in FIGS. 1–2, the cable 7 includes a first cable 71 and a second cable 72. First ends of the respective first cable 71 and the second cable 72 are engaged with and wound around the output drum 62. The first cable 71 is guided through the joint pulley 66 positioned in the side door 1 and the pulley mechanism 8 positioned outside of the rear end of the side door 1 and is introduced rearward along the cable holder 9. The second cable 72 is guided through the pulley mechanism 8 to be introduced forward of the vehicle along the cable holder 9 in the opposite direction from the first cable 71. As shown in FIG. 2, each second end of the cables 71, 72 is diagonally guided onto guide pulleys 82, 83 so that the cables 71, 72 cross each other. The cables 71, 72 are introduced rearward and forward respectively along the cable holder 9 to be engaged with each tensioner 78A, 78B. More particularly, as shown in FIG. 5, a plug 75 including a collar portion 76 is fixed to the second ends of the cables 71, 72 respectively. The plug 75 and a spring 77 are accommodated in a case 78. The biasing load of the spring 77 for always pushing the first cable 71 and the second cable 72 rearward (right direction of FIG. 2) and forward (left direction of FIG. 2) respectively is applied to the collar portion 76 so that a predetermined tension force is provided to the first cable 71 and the second cable 72.

The cable holder 9 is assembled to the vehicle, after engaging a snap 99 of the cable holder 9 to the center guide rail 3, by tightening the front side bracket 93 and the rear side bracket 92 to the body 2 while removing the looseness of the cable by providing the tension load to the first cable 71 and the second cable 72. With the foregoing construction, an interval between end portions of the first cable 71 and the second cable 72 is determined by a length of the cable holder 9 without being influenced by the variation of the vehicle size. In addition, because appropriate tension is applied to the first cable 71 and the second cable 72, the operational load of the driver does not assume too heavy due to the too much tension and the first cable 71 and the second cable 72 are not dislocated from a guiding portion such as the pulley. This ensures the operation with the durability.

Figure 6:
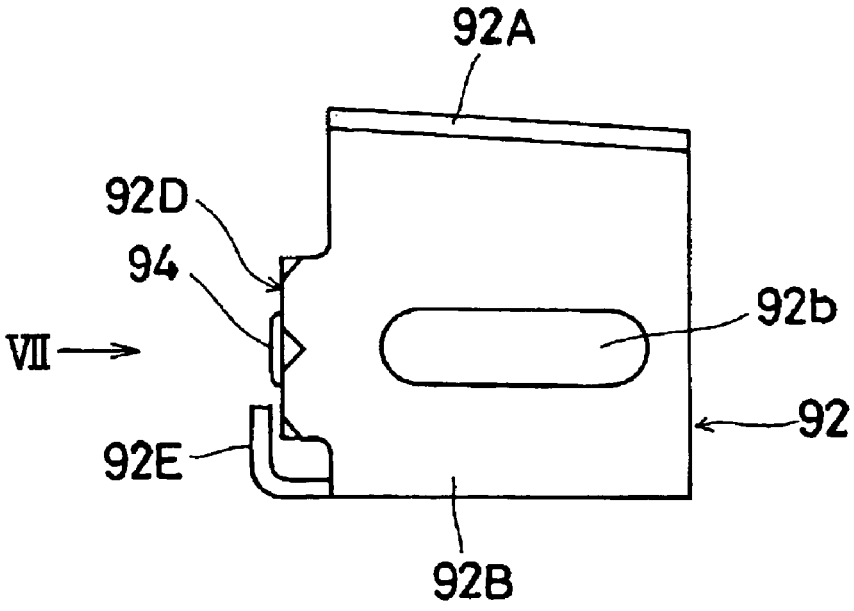
FIG. 6 is a view of a rear side bracket viewed from VI of FIG. 3.
Figure 7:
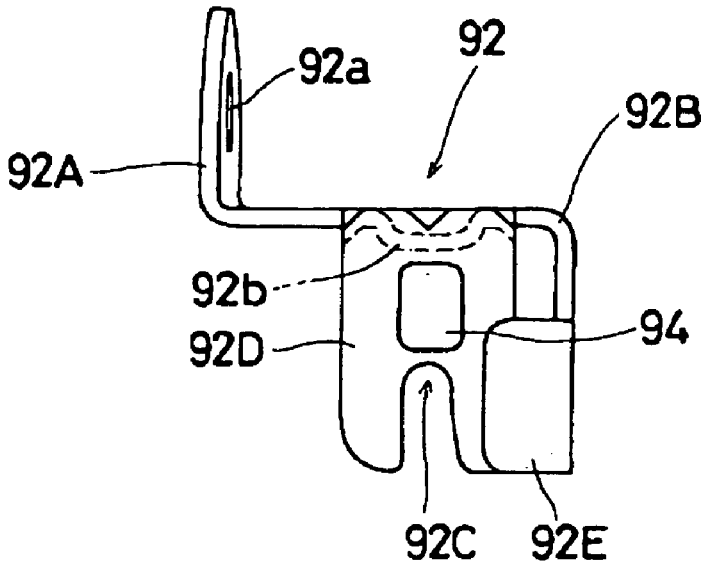
FIG. 7 is a view of the rear side bracket viewed from VII of FIG. 6.

The construction of the rear side bracket 92 and the front side bracket 93 will be further explained as follows. The tensioner 78A provided on the second end of the first cable 71 is assembled to the rear side bracket 92 of the cable holder 9. As shown in FIGS. 6–7, the rear side bracket 92 includes an assembling portion 92A assembled to the vehicle body 2, a supporting portion 92B for supporting the tensioner 78A, and a plane surface portion 92D formed approximately perpendicular to the axis line of the first cable 71 and including a slit shaped stopper portion 92C for stopping the first cable 71. The assembling portion 92A is formed at a portion away from the central axis of the first cable 71. The plane surface portion 92D is formed between the assembling portion 92A and the stopper portion 92C.

The assembling portion 92A includes an assembling bore 92*a*. By assembling the tightening member such as a bolt to the lateral side surface of the assembling portion 92*a*, the rear side bracket 92 is fixed to the lateral side of the body 2. The tensioner 78A is supported by the supporting portion 92B while providing the first cable 71 to the stopper portion 92C. In other words, an end portion of the case 78 of the tensioner 78A contacts the stopper portion 92C while the tension is applied to the first cable 71. In the foregoing manner, the second end of the first cable 71 is assembled to the body 2. The plane surface portion 92D is provided with the strain gauge 94. The strain gauge 94 outputs the electric signal when plane surface portion 92D is deformed. The electric signal outputted from the strain gauge 94 is amplified by an amplifier 65 to be outputted to the door electric control unit 64. A restriction portion 92E for restricting the deformation of the plane surface portion 92D equal to or greater than a predetermined amount is formed on a side of the supporting portion 92B. The restriction portion 92E prevents the plastic deformation of the plane surface portion 92D by the tension of the first cable 71. The supporting potion 92B includes a rib 92*b*. This increases the rigidity of the supporting portion 92B and the supporting portion 92B per se is unlikely deformed. Thus, the rear side bracket 92 includes a construction that the plane surface portion 92D is deformed when the tension is applied to the first cable 71.

Figure 4:
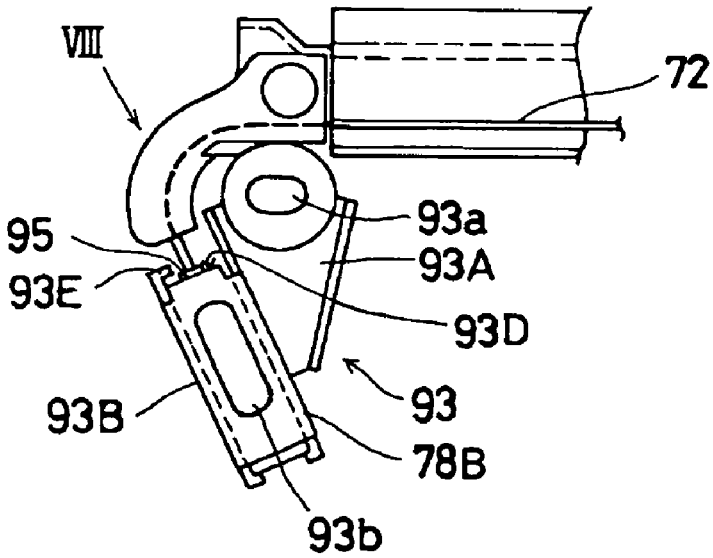
FIG. 4 is a view viewed from IV of FIG. 2.
Figure 8:
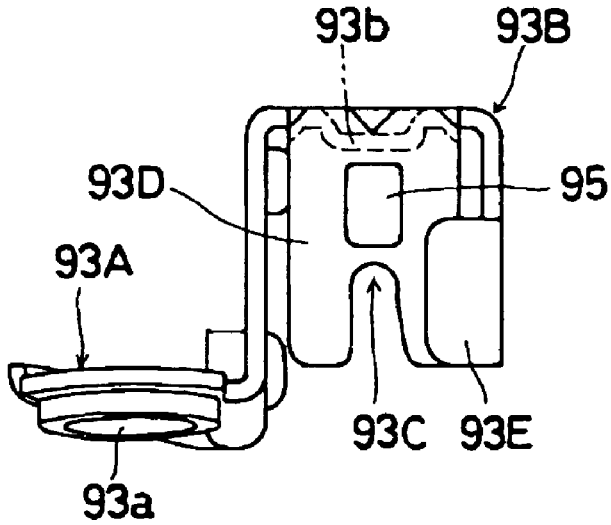
FIG. 8 is a view of a front side bracket viewed from VIII of FIG. 4.

As shown in FIGS. 4 and 8, the tensioner 78B provided on the second end of the second cable 72 is assembled to the front side bracket 93 of the cable holder 9. The front side bracket 93 includes an assembling portion 93A assembled to the vehicle body 2, a supporting portion 93B for supporting the tensioner 78B, and a plane surface portion 93D including a slit shaped stopper portion 93C formed approximately perpendicular to the axis line of the second cable 72 for stopping the second cable 72. The assembling portion 93A is formed at away from the axial center of the second cable 72. The plane surface portion 93D is formed between the assembling portion 93A and the stopper portion 93C.

An assembling bore 93*a* is formed on the assembling portion 93A. By assembling the tightening members such as a bolt on the lateral surface of the body 2 via the assembling bore 93*a*, the front side bracket 93 is fixed relative to the lateral surface of the body 2. The tensioner 78B is supported by the supporting portion 93B while providing the second cable 72 to the stopper portion 93C. In other words, an end portion of the case 78 of the tensioner 78B contacts the stopper portion 93C while the tension is applied to the second cable 72. In the foregoing manner, the second end of the second cable 72 is assembled to the body 2. The planes surface portion 93D is provided with the strain gauge 95. The strain gauge 94 outputs the electric signal when plane surface portion 92D is deformed. The electric signal outputted from the strain gauge 95 is amplified by the amplifier 65 to be outputted to the door electric control unit 64. A restriction portion 93E for restricting the deformation of the plane surface portion 93D equal to or greater than the predetermined amount is formed at a side of the supporting portion 93B. The restriction portion 93E restricts the plastic deformation of the plane surface portion 93D by the tension of the second cable 72. The supporting portion 93B includes a rib 93*b*. This increases the rigidity of the supporting portion 92B and the supporting portion 92B per se is unlikely deformed. It is configured that the plane surface portion 93D is deformed when the tension is applied to the second cable 72.

The operation will be explained as follows. When the output drum 62 is rotated in a first direction by normally driving the electric motor 61 from the closing state of the door opening 21, the first cable 71 is wound by the output drum 62 and the second cable 72 is introduced to the output drum 62 as shown in FIG. 1. Thus, the guide roller units 5A slidingly moves relative to the center guide rail 3 in the rearward direction of the vehicle (i.e., right direction of FIG. 1) to open the door opening 21.

When the output drum 62 is rotated in a second direction by reversely driving the electric motor 61 from the open state of the door opening 21, the second cable 72 of the cable 7 is wound by the output drum 62 and the first cable 71 is released from the output drum 62. Thus, the guide roller units 5A slidingly moves in the forward direction (i.e., left direction of FIG. 1) relative to the center guide rail 3 to close the door opening 21.

The operation when the external object is entrapped between the sliding door 1 and the front rim of the door opening 21 at the closing operation of the slide door 1 and when the external object is entrapped between a window frame of the slide door 1 and the front rim of the door opening 21 at the opening operation of the slide door 1 will be explained as follows.

The large load is applied to the slide door 1 right after the entrapment of the external object than when the external object is not entrapped by the further actuation of the electric motor 61 while the external object is sandwiched between the slide door 1 and the front rim of the door opening 21. This applies the excessive tension to the first cable 71 and the second cable 72 to increase the tension force applied to the stopper portion 92C and the stopper portion 93C by the tensioner 78A, 78B. When the plane surface portion 92D and the plane surface portion 93D are deformed in the axial direction of the cable 7 by the tension of the stopper portion 92C and the stopper portion 93C in the axial direction of the cable 7, the strain gauges 94, 95 output the electric signal in accordance with the deformation of the plane surface portions 92D, 93D. The outputted electric signal is amplified at the amplifier 65 to be inputted into the door electric control unit 64. The door electric control unit 64 judges the entrapment of the external object based on the electric signal from the strain gauges 94, 95.

The door electric control unit 64 may judge the entrapment of the external object as follows. For example, the entrapment of the external object may be judged when a measurement value (ex., voltage value) in accordance with the electric signal from the strain gauges 94, 95 is equal to or greater than a threshold value. In the foregoing way, the entrapment of the external object can be detected only by comparing the measurement value and the threshold value only by predetermining a value at which the entrapment is apparently generated as the threshold value. Accordingly, the entrapment of the external object can be judged easily.

The entrapment of the external object may be judged when a variation amount of the measurement value in accordance with the electric signal from the strain gauges 94, 95 in a predetermined time is equal to or greater than a predetermined amount Because the entrapment is judged when the strain gauge 94, 95 is suddenly strained by the entrapment of the external object, the prompt detection of the entrapment is achieved.

Further, the entrapment of the external object may be judged by determining a value of the electric signal when the electric signal from the strain gauge 94, 95 maintains at an approximately constant value for a predetermined period as a reference value. In this case, the entrapment of the external object is judged when the difference between the measurement value in accordance with the electric signal from the strain gauges 94, 95 and the reference value is equal to or greater than a predetermined value. With this method, the entrapment of the external object can be securely judged even when the brackets 92, 93 are deformed from the initial configuration due to the aging and the environment used so that the strain gauges 94, 95 always output the electric signal irrespective of the load applied to the slide door 1.

Thus, by assembling the strain gauge to the bracket deformed in accordance with the load applied to the slide door, the entrapment of the external object can be securely detected and the detection timing is unlikely delayed.

Although the present invention is explained with an embodiment applying the detection device for the entrapment of the opening-closing member to the slide door, the detection device for the entrapment of the opening-closing member can be applied to other opening-closing bodies such as the backdoor of a van and a sunroof.

According to the embodiment of the present invention, because the strain gauge is used for detecting the entrapment of the external object, the load applied to the opening-closing member is increased when the external object is entrapped, and thus the detection of the entrapment of the external object by the strain gauge can be securely performed.

In addition, because the member assembled with the strain gauge is the material deformed in accordance with the load applied to the opening-closing member, the time lag from the actual entrapment of the external object to the detection of the entrapment of the external object can be restrained relative to the detection device for detecting the entrapment of the external object in accordance with the variation of the electric current and the rotational speed of the electric motor for actuating the opening-closing member.

According to the embodiment of the present invention, the actuation of the electric motor continues in order to displace the opening-closing member to the completely closed position or to the completely open position at a stage when the external object is entrapped during the process for the displacement of the opening-closing member to the completely closed position or to the completely open position. In this case, although the electric motor actuates for winding the cable, the bracket may be deformed due to the excessive tension applied to the cable at a state that the position of the opening-closing member is unlikely displaced due to the entrapment of the external object. By outputting the electric signal in accordance with the deformation of the bracket by the strain gauge, the control mechanism detects the entrapment of the external object. Thus, the detection of the prompt and secure entrapment of the external object assumes detectable.

According to the embodiment of the present invention, when the excessive tension is applied to the cable, the plane surface portion is deformed to strain the strain gauge in accordance with the deformation of the plane surface portion, thus the secure and the prompt detection of the entrapment of the external object assumes detectable.

According to the embodiment of the present invention, when the excessive tension is applied to the cable, the deformation at a portion between the assembling portion of the bracket and the stopper portion assumes relatively large. Accordingly, the detection of the strain by the strain gauge is securely performed.

According to the embodiment of the present invention, the entrapment of the external object is judged when the electric signal in accordance with the strain of the strain gauge assumes equal to or greater than the predetermined threshold value with the control mechanism. In this case, by predetermining the value at which apparently the entrapment of the external object is generated as the threshold value, the entrapment of the external object can be detected by comparing the outputted electric signal and the threshold value. This enables easy judgment of the entrapment of the external object.

According to the embodiment of the present invention, the entrapment of the external object is judged based on the variation of the electric signal per a predetermined time, in other words, based on the variation speed of the electric signal. Thus, the entrapment of the external object is judged when the strain gauge is suddenly deformed by the entrapment of the external object. This enables fast detection of the entrapment.

According to the embodiment of the present invention, the entrapment of the external object can be securely judged even when the member is maintained deformed due to the aging and the environment used and the gauge is strained irrespective of the load applied to the opening-closing member.

The principles, preferred embodiment and mode of operation of the present invention have been described in the foregoing specification. However, the invention which is intended to be protected is not to be construed as limited to the particular embodiment disclosed. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. An entrapment detection device of an opening-closing member which opens and closes an opening portion of a vehicle body comprising:

a driving power source for moving the opening-closing member;

a motivity transmission member provided between the opening-closing member and the driving power source;

the motivity transmission member comprising a cable which moves in accordance with actuation of the driving power source and connected to the vehicle body by a bracket;

the bracket including a deformation member configured to be deformed via the motivity transmission member in accordance with the load applied to the opening-closing member during an motivity transmission operation of the opening-closing member;

a strain gauge assembled to the deformation member and configured to convert a strain according to the deformation of the deformation member to an electric signal; and a control mechanism for detecting an entrapment of an external between said opening-closing member and the vehicle body object based on the electric signal from the strain gauge.

2. The entrapment detection device according to claim 1, wherein the bracket includes a stopper portion for stopping the cable.

3. The entrapment detection device according to claim 2, wherein the deformation member of the bracket comprises a plane surface portion of the bracket that is configured to be approximately perpendicular to a longitudinal axis of the cable, and the strain gauge is mounted on the plane surface portion.

4. The entrapment detection device according to claim 3, wherein the bracket further includes an assembling portion disposed away from said longitudinal axis of the cable for assembling the bracket relative to the vehicle body and the plane surface portion is formed between the assembling portion and the stopper portion.

5. The entrapment detection device according to claim 1, wherein the control mechanism judges the entrapment of the external object when a value of the electric signal from the strain gauge is equal to or greater than a threshold value.

6. The entrapment detection device according to claim 1, wherein the control mechanism judges the entrapment of the external object when a variation of the electric signal from the strain gauge per a predetermined time is equal to or greater than a predetermined amount.

7. The entrapment detection device according to claim 1, wherein the control mechanism judges the entrapment of the external object when a difference between the electric signal from the strain gauge and a reference value, is equal to or greater than a predetermined value, the reference value being determined as the electric signal from the strain gauge that is maintained as a substantially constant value for a predetermined period of time.

8. An entrapment detection device of an opening-closing member which opens and closes an opening portion of a vehicle body comprising:

a driving power source for moving the opening-closing member;

a cable extending between the opening-closing member and the driving power source, with output of the driving power source moving the opening-closing member by way of the cable;

the cable being connected to a bracket which is adapted to be mounted on the vehicle body;

a strain gauge mounted on a portion of the bracket to produce a signal upon deformation of the portion of the bracket by said cable; and a control mechanism which detects entrapment of an object between said opening-closing member and the vehicle body based on the signal produced by the strain gauge.

9. The entrapment detection device according to claim 8, wherein the cable is connected to a tensioner, and the bracket includes a stopper portion adapted to be contacted by the tensioner.

10. The entrapment detection device according to claim 9, wherein the portion of the bracket on which the strain gauge is mounted is a plane surface portion that is approximately perpendicular to a longitudinal axis of the cable.

11. The entrapment detection device according to claim 10, wherein the bracket further includes an assembling portion provided with a bore for assembling the bracket to the vehicle body, the plane surface portion being positioned between the assembling portion and the stopper portion.

12. The entrapment detection device according to claim 8, wherein the control mechanism detects the entrapment of the object when a value of the signal from the strain gauge is equal to or greater than a threshold value.

13. The entrapment detection device according to claim 8, wherein the portion of the bracket on which the strain gauge is mounted is a plane surface portion that is approximately perpendicular to a longitudinal axis of the cable.

14. The entrapment detection device according to claim 8, wherein the bracket further includes an assembling portion provided with a bore for assembling the bracket to the vehicle body.

15. The entrapment detection device according to claim 8, wherein the control mechanism detects the entrapment of the object when a variation amount of the signal from the strain gauge per a predetermined time is equal to or greater than a predetermined amount.

16. The entrapment detection device according to claim 8, wherein the control mechanism determines a reference value to be the signal from the strain gauge when the signal is maintained at an approximately constant value for a predetermined period of time, the control mechanism detecting entrapment of the object when a difference between the signal from the strain gauge and the reference value is equal to or greater than a predetermined value.

* * * * *